US006799004B2

(12) United States Patent
Richtsmeier

(10) Patent No.: US 6,799,004 B2
(45) Date of Patent: Sep. 28, 2004

(54) IMAGING EQUIPMENT ACCELERATION APPARATUS AND METHODS

(75) Inventor: Dean J. Richtsmeier, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 41 days.

(21) Appl. No.: 10/247,498

(22) Filed: Sep. 19, 2002

(65) Prior Publication Data

US 2004/0057742 A1 Mar. 25, 2004

(51) Int. Cl.[7] ..... G03G 15/20
(52) U.S. Cl. ..... 399/70
(58) Field of Search ..... 399/37, 44, 66, 399/67, 69, 70, 88, 9, 11, 68

(56) References Cited

U.S. PATENT DOCUMENTS 4,113,391 A 9/1978 Minowa
4,262,188 A 4/1981 Beach
4,409,600 A 10/1983 Minowa
4,543,587 A 9/1985 Kurata et al.
5,317,571 A 5/1994 Marcel et al.
5,432,533 A 7/1995 Shibamiya
5,469,068 A 11/1995 Katsuma
5,521,686 A 5/1996 Muto
5,563,696 A 10/1996 Futagawa et al.
5,742,865 A 4/1998 Yajima et al.
5,771,421 A * 6/1998 Kim ..... 399/44
5,854,957 A 12/1998 Morikawa
6,096,995 A 8/2000 Toyota et al.
6,160,975 A 12/2000 Bartley et al.
6,172,762 B1 1/2001 Uchiyama
6,259,870 B1 7/2001 Sugimoto
6,335,797 B1 1/2002 Hirosawa
6,353,719 B1 3/2002 Lee
6,369,917 B1 4/2002 Sawada

* cited by examiner

*Primary Examiner*—Hoang Ngo

(57) ABSTRACT

Disclosed herein is apparatus and method for accelerating a processing period for imaging equipment.

12 Claims, 7 Drawing Sheets

IMAGING EQUIPMENT ACCELERATION APPARATUS AND METHODS

BACKGROUND

Printers are output devices utilized to create an image on a sheet of media. One type of conventional printer 10 is shown in FIG. 1. The printer 10 may be provided with a sheet 12, a stack 14 and an input tray 16. The sheet 12 may be located on an uppermost portion of the stack 14 of media. This stack 14 may be located in the input tray 16.

The printer 10 may also be provided with a pick mechanism 18, a path 20, an imaging component 22, a fuser 24 and an output tray 26. The pick mechanism 18 may move individual sheets from the stack 14 (e.g. sheet 12) into the path 20 that extends through the printer 10. The sheet 12 travels through the printer 10 along the path 20 where a toner image may be formed on the sheet 12 by the imaging component 22. After forming the toner image on the sheet 12, the fuser 24 may fuse the toner image on the sheet 12. This fusing process creates a fused image on the sheet 12. The fused image on the sheet 12 creates a durable document that can be distributed, read, stored, etc. The output tray 26 may be located at the end of the path 20 for receiving processed sheets, such as sheet 12.

The printer 10 may be further provided with a temperature sensor 28, a controller 30 and a heater 32. The temperature sensor 28 may take the form of a thermistor located in the fuser 24. The controller 30 may be a pre-programmed application specific integrated circuit (ASIC) or pre-programmed microprocessor operationally associated with the printer 10. The heater 32 may take the form of a ceramic heater located within (or in thermal communication with) the fuser 24. In a process that will be described later herein, the heater 32 can be activated to increase the temperature of the fuser 24. The sensor 28 can report this increase of temperature to the controller 30; the controller 30 can activate or deactivate the heater 32 as required to maintain a particular temperature of the fuser 24.

The fuser 24 operates at an operating temperature 'T1' that is higher than ambient temperature 'T0'. As used herein, the term 'operating temperature'T1 is defined as the temperature of the fuser 24 that allows for proper fusing of toner onto sheets of media. As used herein, the term 'ambient temperature' T0 is defined as the temperature of the fuser 24 when the printer 10 is not being used and is essentially dormant (which results in the fuser 24 being deactivated for a long enough period of time to have any residual heat dissipated therefrom, this period of time may be about 45 minutes to one hour).

Overview of Conventional Process

The printer 10 may form and fuse the image on the sheet 12 in a series of steps as it travels along path 20 (FIG. 1). These steps may include a warm-up step, a feed step, a fusing step and an ejecting step. Timelines shown in FIGS. 2 and 3 illustrate two types of conventional forming and fusing processes. These processes are illustrated in the timelines as a time graph 'S', a sheet velocity graph 'V' and a fuser temperature graph 'T'. The first type of conventional process illustrated in FIG. 2 is a sequential process. The second type of conventional process illustrated in FIG. 3 is a fixed delay process.

Conventional Sequential Process

With reference to FIG. 2, the sequential forming and fusing process may commence at a start point denoted by 'A'. During the warm-up step occurring during period 'S1', the heater 32 (FIG. 1) may be activated to bring the fuser 24 from the ambient temperature T0 towards the operating temperature T1 (shown in the fuser temperature graph T). It takes the entire warm-up step period S1 to bring the fuser 24 to its operating temperature T1. Once the sensor 28 (FIG. 1) senses and reports the operating temperature T1, the heater 32 may be deactivated or, alternatively, power supplied thereto may be substantially reduced. By deactivating or reducing power supplied to the heater 32, the operating temperature T1 is substantially maintained. A preheated point denoted by 'B' (FIG. 2) denotes when the fuser 24 is at the operating temperature T1. After the preheated point B, the feed step may occur during period 'S2'.

Referring to FIG. 1, during the feed step period S2 (FIG. 2), the picker 18 may advance the sheet 12 from the stack 14 towards the imaging component 22 along the path 20. As shown in the velocity sheet graph V (FIG. 2), the sheet 12 may travel along path 20 at a velocity V1. The sheet 12 passes through the imaging component 22 where the toner image may be formed thereon as it travels along the path 20. At a fusing point denoted by 'C', the fusing step may occur during period 'S3' (FIG. 2).

Referring again to FIG. 1, during the fusing step period S3 (FIG. 2), the fuser 24 may fuse the toner image to the sheet 12 as it travels along the path 20. Once the toner image is fused to the sheet 12, it has been converted to a fused image. The fuser 24 may fuse the toner image by applying heat to the toner image and sheet 12. As shown in the temperature graph T (FIG. 2), the fuser temperature may vary slightly from, but remain substantially close to, the operating temperature T1 (as previously mentioned, the operating temperature T1 may be maintained by selectively activating of the heater 32 as directed by the sensor 28 and/or the controller 30). At an ejecting point denoted by 'D' (FIG. 2), the fusing process has ended and the ejecting step may occur during period 'S4' (FIG. 2).

During the ejecting step period S4, the sheet 12 may be ejected from the path 20. This sheet 12 is ejected to the output tray 26, FIG. 1. At an exit point denoted by 'E' (FIG. 2), the sheet 12 may be completely ejected from the path 20. After the sheet 12 is removed from the path 20, its velocity returns to zero as shown in the velocity graph V. The sheet 12 with the image formed thereon may be stored in the output tray 26 (FIG. 1) along with other sheets that have been processed.

As Illustrated in FIG. 2, the accumulation of time from the start point A to the exit point E may be referred to herein as a conventional sequential processing period denoted by 'S5'. The conventional sequential processing period S5 is an accumulation of the individual steps taken to create the image on the sheet 12. As shown in FIG. 2, the conventional sequential processing period S5 may include the warm-up step period S1, the feed step period S2, the fusing step period S3 and the ejecting step period S4. The conventional processing period S5 may be calculated according to the following equation:

$$S5 = S1 + S2 + S3 + S4, \text{ wherein:}$$

$S1$ is the warm-up step period;

-continued $S2$ is the feed step period;

$S3$ is the fusing step period; and, $S4$ is the ejecting step period.

When a user desires to print a sheet (i.e. creating a durable image on sheet 12), this type of conventional printer 10 takes the conventional sequential processing period S5 to eject the first sheet with the image formed thereon. The conventional sequential processing period S5 to eject the first sheet is commonly referred to in the art as 'first page out time'. The first page out time is a common benchmark for comparing printers.

Conventional Fixed Delay Process

Another type of conventional printer 10 that uses a fixed delay period is illustrated in a timeline in FIG. 3. This fixed delay period is denoted by 'Sfd' and is used to decrease the first page out time of printer 10. This fixed delay period Sfd may be a value that is pre-programmed into the printer at the time of manufacture. The fixed delay period Sfd is a 'worst-case-scenario' period of time to bring the fuser 24 (FIG. 1) to the operating temperature T1. Factors that may result in the worst-case-scenario include, but are not limited to, low line voltage, low ambient temperature, high humidity, thick media, reduced resistance of the heater 32, etc.

With continued reference to FIG. 3, this forming and fusing process may commence at a start point denoted by 'A'. During the warm-up step occurring during period 'S1', the heater 32 may be activated to bring the fuser 24 (FIG. 1) from the ambient temperature T0 towards the operating temperature T1 (shown in the temperature graph T.) At a preheated point denoted by 'B', the fuser 24 is, essentially, at the operating temperature T1. After the fixed delay period Sfd, a feeding point denoted by 'B2' may represent the start of the feed step. The feed step may occur during period 'S2' that partially occurs during the warm-up step period S1. It should be noted that since the fixed delay period Sfd is determined for the worst-case-scenario, the fuser 24 is usually at the operating temperature T1 before the fusing step period S3 starts. By accommodating for the worst-case-scenario, the first page out time is slower than it could be.

With reference to FIG. 1, during the feed step period S2 (FIG. 3), the picker 18 may advance the sheet 12 from the stack 14 towards the imaging component 22 along the path 20. As shown in the sheet velocity graph V in FIG. 3, the sheet 12 may travel along path 20 at a velocity V1 towards the imaging component 22. A toner image may be formed on the sheet 12 as it travels through the imaging component 22. With referent to FIG. 3, at a fusing point denoted by 'C', the fusing step may occur during period 'S3'.

Referring again to FIG. 1, during the fusing step period S3 (FIG. 3), the fuser 24 may fuse the toner image to the sheet 12 as it travels along the path 20. Once the toner image is fused to the sheet 12, it has been converted to a fused image. The fuser 24 may fuse the toner image by applying heat to the toner image and sheet 12. As shown in the temperature graph T (FIG. 3), the fuser temperature may vary slightly from, but remain substantially close to, the operating temperature T1. At an ejecting point denoted by 'D' (FIG. 3), the fusing process has begun and the ejecting step may occur during period 'S4' (FIG. 3).

During the ejecting step period S4, the sheet 12 may be ejected from the path 20. This sheet 12 is ejected to the output tray 26, FIG. 1. At an exit point denoted by 'E' (FIG. 3), the sheet 12 may be completely ejected from the path 20. After the sheet 12 is removed from the path 20, its velocity returns to zero as shown in the velocity graph V. The sheet 12 with the image formed thereon may be stored in the output tray 26 (FIG. 1) along with other sheets that have been processed.

As illustrated in FIG. 3, the accumulation of time from the start point A to the exit point E may be referred to herein as a conventional fixed delayed processing period denoted by 'S7'. The conventional fixed delayed processing period S7 is an accumulation of time of steps taken to process the sheet 12. As shown in FIG. 3, the conventional fixed delayed processing period S7 may include the fixed delay step period Sfd, the feed step period S2, the fusing step period S3 and the ejecting step period S4. The conventional fixed delayed processing period S7 may be calculated according to the following equation:

$$S7 = Sfd + S2 + S3 + S4, \text{ wherein:}$$

$Sfd$ is the fixed delayed step period;

$S2$ is the feed step period;

$S3$ is the fusing step period; and, $S4$ is the ejecting step period.

When a user desires to print a sheet (i.e. forming an image on sheet 12), the conventional printer 10 takes the conventional fixed delayed processing period S7 to eject the first sheet with the image formed thereon.

These conventional apparatus and methods result in the fusing point C occurring after the preheated point B By providing the preheated point B before the fusing point C, these conventional printers properly fuse the toner to the sheet 12, even if the line voltage is low, the ambient temperature is low, the humidity is high, the media is thick, the resistance of the heater 32 is reduced, etc.

SUMMARY

In exemplary embodiments, methods and apparatus for processing a sheet may include: providing an imaging apparatus comprising an input separated from a processing component by a path, the processing component comprising an idling state and a processing state; storing a warm-up step period that is unique to the processing component, the warm-up step period being defined by a period of time to bring the processing component from the idling state to the processing stating; activating the processing component, thereby urging the processing component from the idling state towards the processing state; according to the warm-up period, moving the sheet from the input along the path towards the processing component; and processing the sheet with the processing component.

DETAILED DESCRIPTION

The apparatus and method described herein may be used in imaging equipment such as printers, copy machines, facsimile machines, scanners, etc. Although the present disclosure is, for illustrative purposes only, directed to a printer, it is to be understood that the methods and apparatus disclosed herein may be utilized in any of the devices previously mentioned, or other imaging equipment.

In general terms, the present acceleration apparatus and method improves first page out time by adapting to changes in printing factors (e.g. changes in the voltage of the power grid to which the device is attached, changes in the ambient temperature, changes in resistance of a heater, etc.) that impact the time it takes to bring a processing component to an operating state. This adaptation usually results in a forming step beginning to occur essentially simultaneously as the processing component reaches its operating state.

Figure 1:
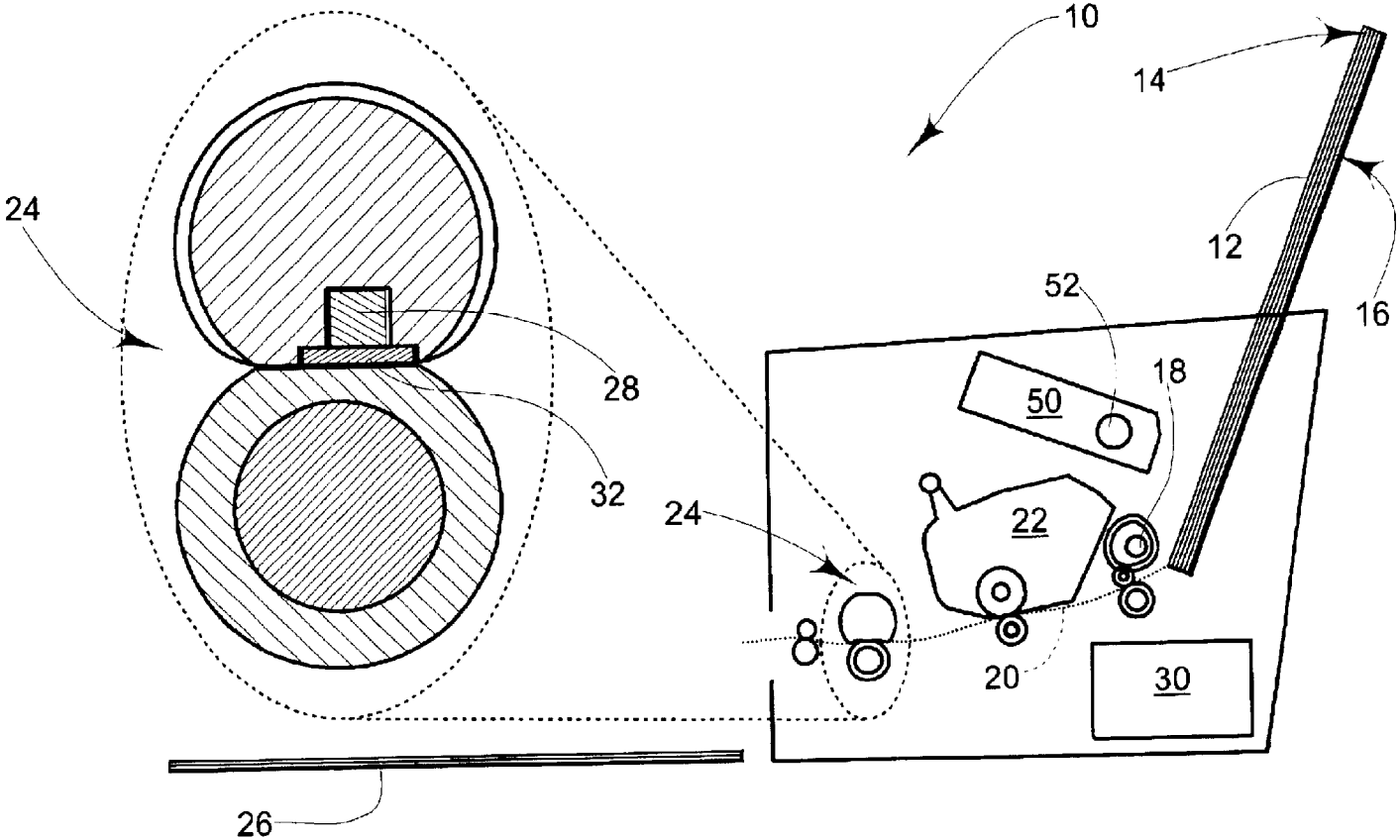
FIG. 1 (PRIOR ART)
FIG. 1 shows a schematic side elevation diagram of one type of conventional imaging apparatus.

Having provided a brief introduction, a detailed description will now proceed. It is noted that some reference numerals used to describe the prior art have been retained for descriptive purposes. In one type of printer (e.g. printer 40, FIG. 4), the components may be somewhat similar to those found in conventional printer 10 (FIG. 1) (with some exceptions described later herein).

Figure 4:
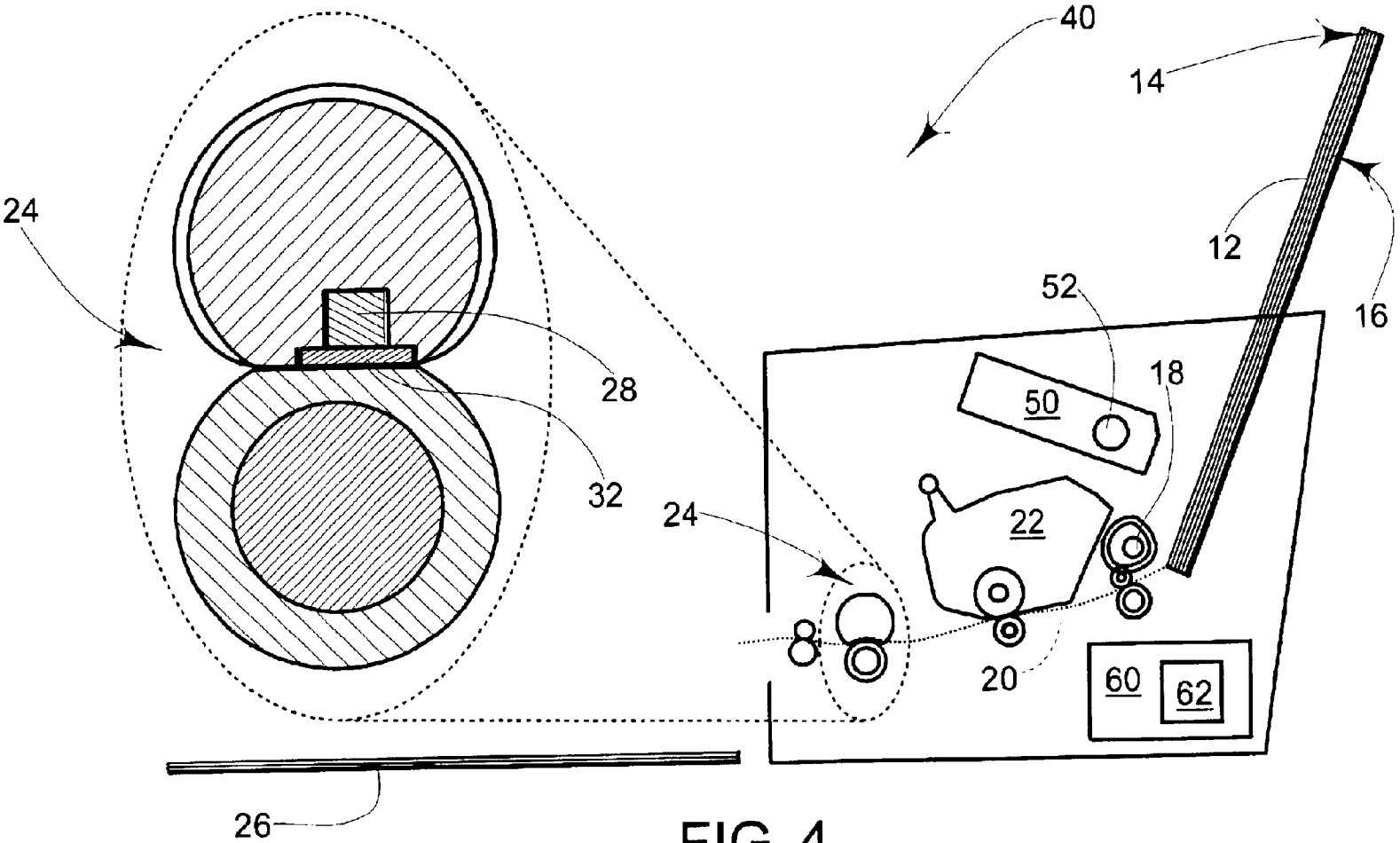
FIG. 4 shows a schematic side elevation diagram of one embodiment of an exemplary imaging apparatus.

With reference to FIG. 4, a printer 40 may be provided with a sheet 12, a stack of media 14 and an input tray 16. The sheet 12 may be located on an uppermost portion of the stack 14 of media. The stack 14 may be located in the input tray 16.

The printer 40 may be further provided with a pick mechanism 18, a path 20 and an imaging component 22. The pick mechanism 18 may be positioned between the stack 14 and the path 20 so that it can move the sheet 12 from the stack 14 to the path 20. While the sheet 12 travels through the printer 40 along the path 20, a toner image may be formed thereon at the imaging component 22.

With continued reference to FIG. 4, the printer 40 may be further provided with a fuser 24 and an output tray 26. The fuser 24 may be utilized to fuse the toner image on the sheet 12 after forming the toner image on the sheet 12. Fusing the toner image onto the sheet 12 creates a durable document that can be distributed, read, stored, etc. The output tray 26 may be located at an end of the path 20 for receiving sheets with images formed thereon.

As illustrated in FIG. 4, the present printer 40 may be further provided with a temperature sensor 28, a heater 32, a controller 60 and memory 62. The temperature sensor 28 may be a thermistor disposed in the fuser 24. The controller 60 may take the form of an application specific integrated circuit (ASIC) or microprocessor operationally associated with the present printer 40. The controller 60 has the memory 62 associated therewith; the memory 62 can be incorporated within the controller 60 itself or, alternatively, with other circuitry associated with the printer 40 (e.g. a personal computer). In a process described later herein, operating characteristics of the printer 40 may be stored in the memory 62. The heater 32 may take the form of a ceramic element located within (or in thermal communication with) the fuser 24. In a process that will be described later herein, the heater 32 can be activated to increase the temperature of the fuser 24. The sensor 28 can report this increase of temperature to the controller 60; the controller 60 can activate or deactivate the heater 32 as required to maintain a particular temperature of the fuser 24.

The printer 40 may be provided with an 'idling state' and a 'processing state'. The fuser 24 operates at an operating temperature 'T1' that is higher than ambient temperature 'T0'. As used herein, the term 'idling state' may be defined as a condition when the fuser 24 is at the ambient temperature T0. As also used herein, the term 'processing state' may be defined as a condition when the fuser 24 is at the operating temperature T1.

The printer 40 may form and fuse the image on the sheet 12 in a series of steps as it travels along path 20 (FIG. 4). An accelerated timeline shown in FIG. 5 illustrates an accelerated forming and fusing process represented as a time graph 'S', a sheet velocity graph 'V' and a fuser temperature graph 'T'.

Figure 5:
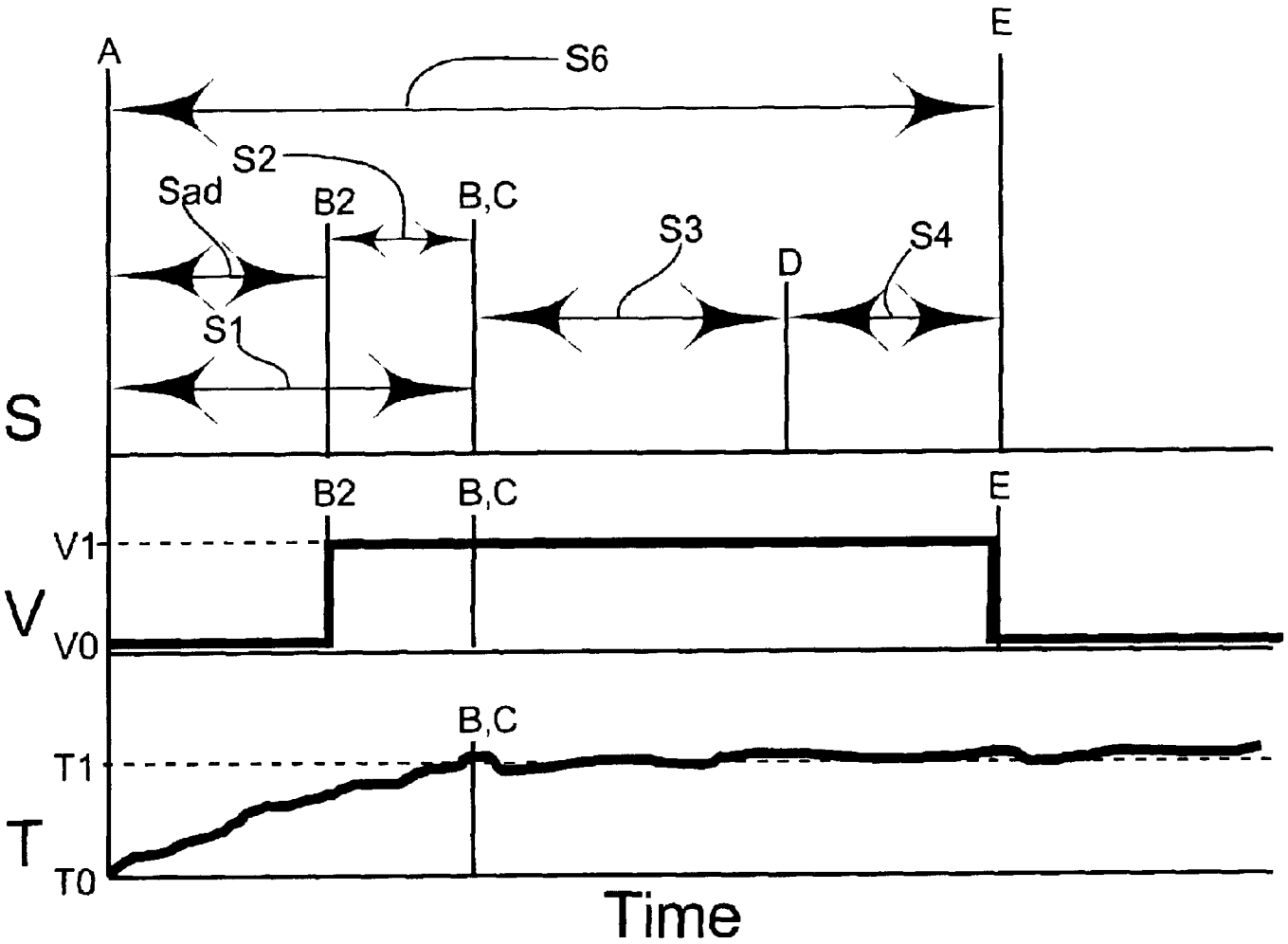
FIG. 5 shows a timeline illustrating an exemplary embodiment of an imaging apparatus acceleration method.

With reference to FIG. 5 the accelerated forming and fusing process may be provided with an adaptive feed delay period, a warm-up step period, a feed step period, a fusing step period and an ejecting step period. The accelerated forming and fusing process may commence at a start point denoted by 'A'. During the warm-up step occurring during period 'S1', the heater 32 (FIG. 4) may be activated to bring the fuser 24 from the ambient temperature T0 towards the operating temperature T1 (shown in the temperature graph T). At a preheated point denoted by 'B', the fuser 24 is at the operating temperature T1. The maintenance of the operating temperature T1 of the fuser 24 may be directed by the controller 60 or, alternatively, directly by the sensor 28. For illustrative purposes only, the ambient temperature T0 may be about seventy degrees Fahrenheit and the operating temperature T1 may be about three hundred and seventy-five degrees Fahrenheit.

The adaptive feed delay period is denoted by 'Sad' and may be a period of time that is essentially equal to the difference between the warm-up step period S1 and the feed step period denoted by 'S2'. The adaptive feed delay period Sad may be calculated according to the following equation:

$$Sad = S1 - S2, \text{ wherein:}$$

$Sad$ is the adaptive feed delay period;

$S1$ is the warm-up step period; and, $S2$ is the feed step period.

This adaptive feed delay period is determined, evaluated and modified according to a process described later herein. Additionally, this adaptive feed delay period Sad may be stored in the memory 62.

After passage of the adaptive feed delay period Sad, the feed step period denoted by 'S2' may begin. The beginning of the feed step period S2 is referred to as a feeding point denoted by 'B2'. This feeding point B2 always occurs before the preheated point B. The feed step S2 occurs, at least partially, during the warm-up step period S1.

With reference to FIG. 4, during the feed step period S2 (FIG. 5), the picker 18 may move the sheet 12 from the stack 14 into the path 20. As shown in the sheet velocity graph V in FIG. 5, the sheet 12 may travel along path 20 at a velocity V1 towards the imaging component 22. While traveling through the imaging component 22, a toner image may be formed on the sheet 12. At a fusing point denoted by 'C', the fusing step occurring during period 'S3' may begin.

Figure 2:
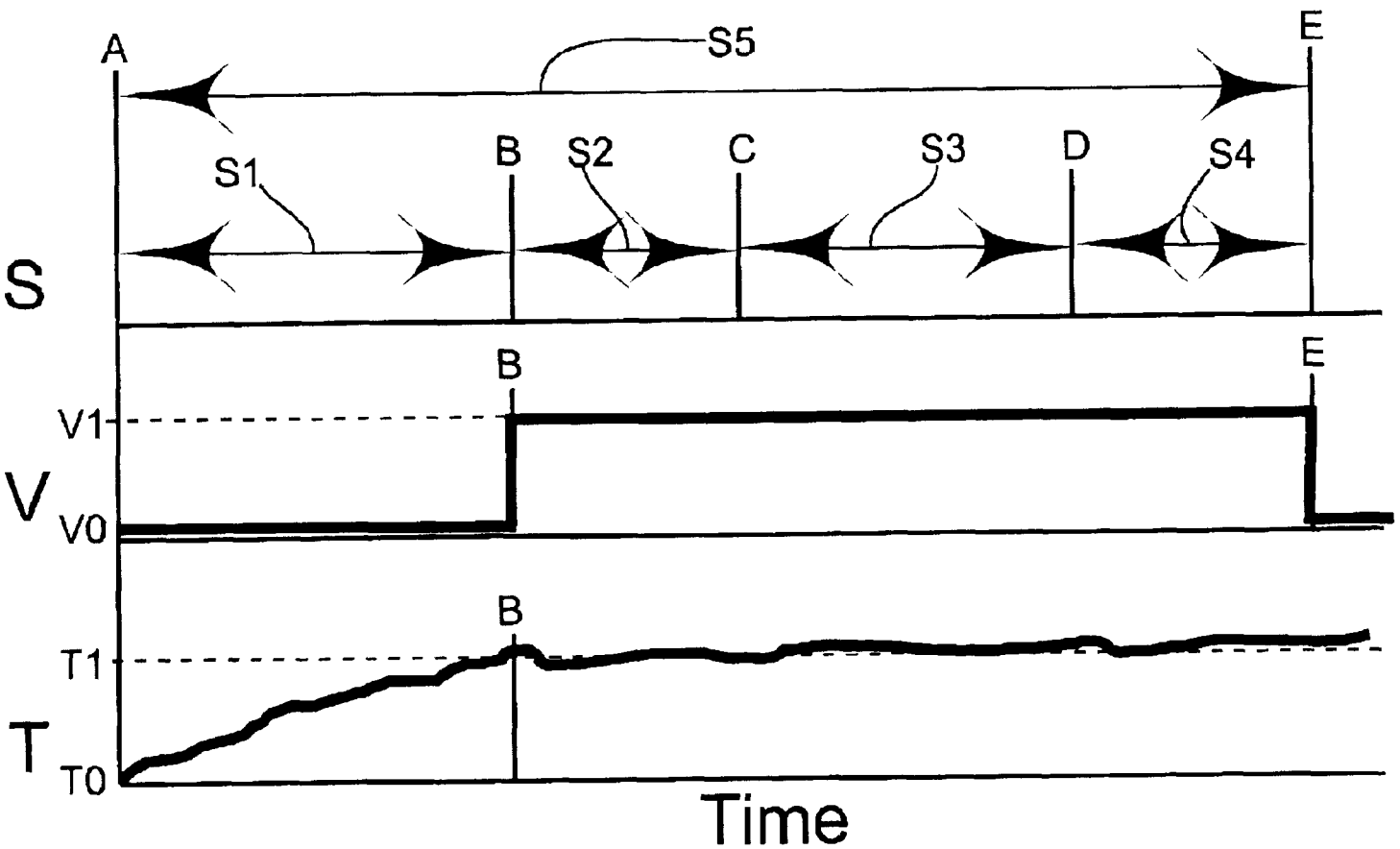
FIG. 2 (PRIOR ART)
FIG. 2 shows a timeline illustrating a conventional sequential process for forming and fusing an image onto a sheet of media.

The present acceleration method results in the fusing point C occurring substantially simultaneously with completion of the warm-up step period S2 (identified by the preheated point B). This differs from the conventional printer 10 (FIG. 1) wherein the fusing point C occurs after the preheat point B (as illustrated in FIG. 2). In other words, the present printer 40 (FIG. 4) fuses the toner image to the sheet 12 at substantially the same moment as the fuser 24 reaches the operating temperature T1 (whereas the conventional printer 10 allows the fuser 24 to reach the operating temperature T1 before the fusing step occurs).

With reference to FIG. 4, during the fusing step period S3 (FIG. 5), the fuser 24 fuses the toner image to the sheet 12 as it travels along the path 20, thereby creating the fused image. The fuser 24 may fuse the image by applying heat to the toner image and the sheet 12. As shown in the temperature graph T in FIG. 5, the temperature of the fuser 24 may vary slightly from, but remain substantially close to, the operating temperature T1. At an ejecting point denoted by 'D', the fusing step has started and an ejecting step may occur during period 'S4'.

With reference to FIG. 4, during the ejecting step period S4 (FIG. 5), the sheet 12 with the image formed thereon may be ejected from the path 20 to the output tray 26. With reference to FIG. 5, at an exit point denoted by 'E', the sheet 12 is completely removed from the path 20. After the sheet 12 is removed from the path 20, its velocity returns to zero as shown in the velocity graph V. The sheet 12 with the image formed thereon may be stored in the output tray 26 along with other sheets that have been processed.

As illustrated in FIG. 5, the accumulation of time from the start point A to the exit point E is referred to herein as an accelerated processing period denoted by 'S6'. The accelerated processing period S6 is an accumulation of the individual steps taken to create the image on the sheet 12. As shown in FIG. 5, the accelerated processing period S6 includes the warm-up step period S1, the fusing step period S3 and the ejecting step period S4. The accelerated processing period S6 may be calculated according to the following equation:

$S6 = S1 + S3 + S4$, wherein:

$S1$ is the warm-up step period;

$S3$ is the fusing step period; and, $S4$ is the ejecting step period.

Figure 3:
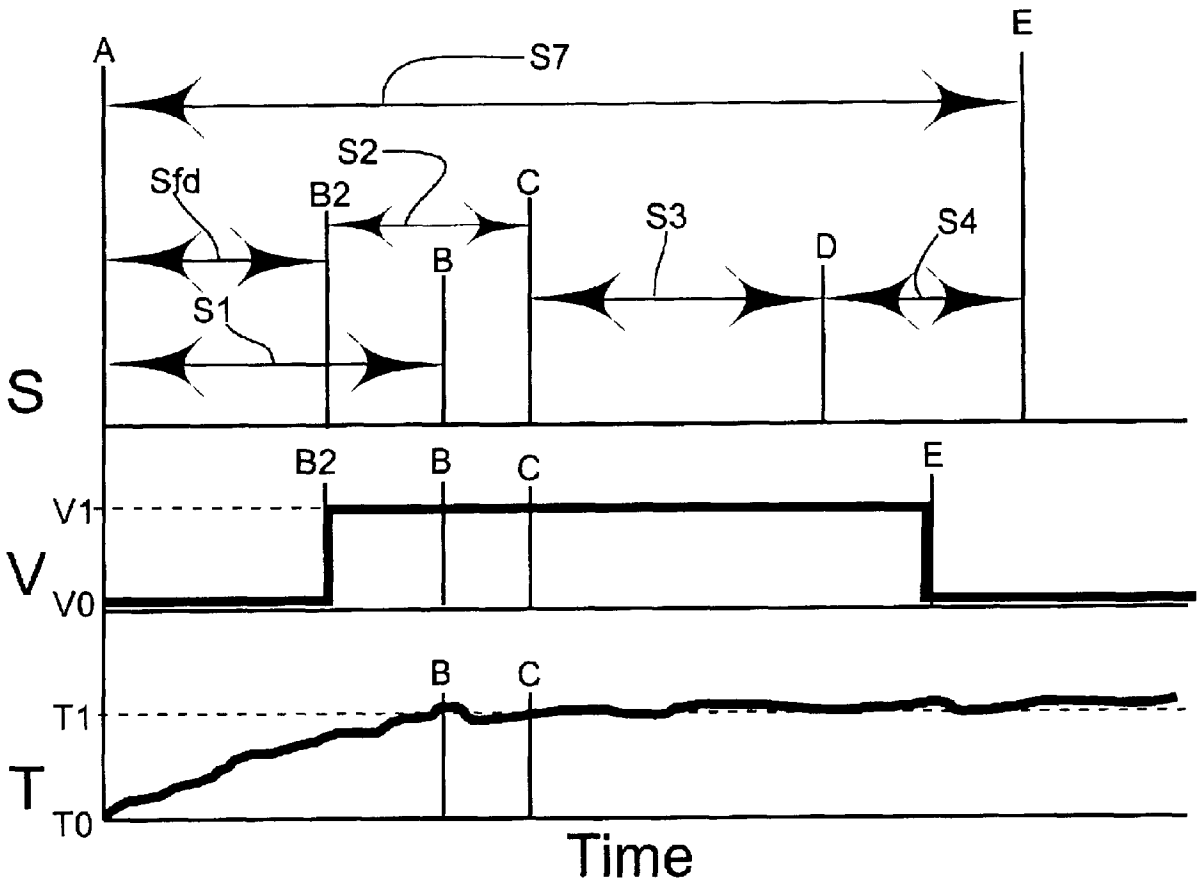
FIG. 3 (PRIOR ART)
FIG. 3 shows a timeline illustrating a conventional fixed delayed process for forming and fusing an image onto a sheet of media.

It should be noted that this accelerated processing period S6 is usually shorter than the conventional sequential processing period S5 (FIG. 2) or the conventional fixed delayed processing period S7 (FIG. 3) because the feed step period S2 occurs (at least partially) during the warm-up period S1 rather than after the warm-up step S1 or the worst-case-scenario fixed delay period Sfd in conventional methods. Since the accelerated processing period S6 is usually shorter than the conventional processing period S5, the first page out time is reduced.

Figure 6:
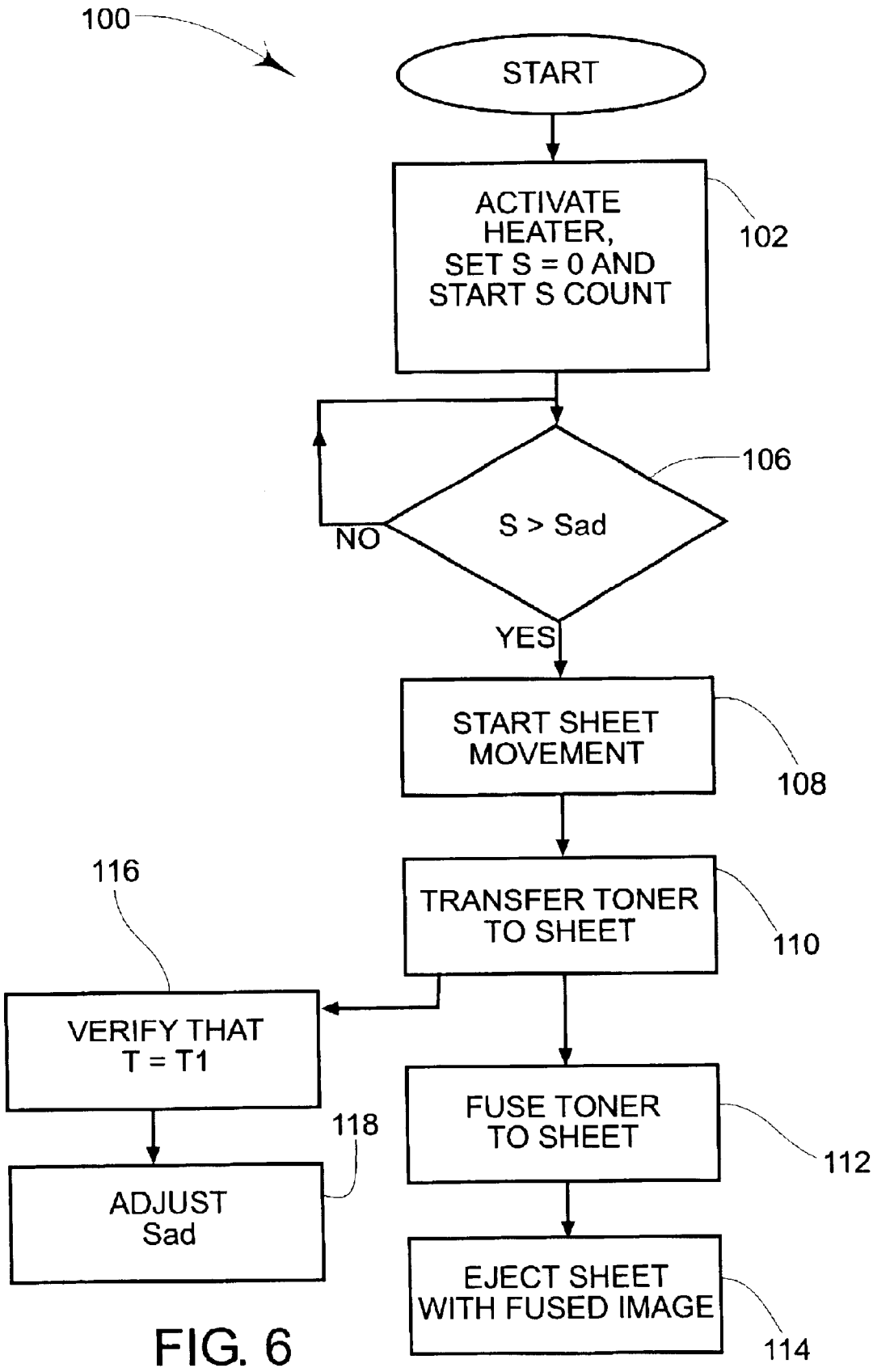
FIG. 6 shows a block diagram of steps occurring during an exemplary acceleration method.

The previously described exemplary acceleration method can also be represented in a block diagram as illustrated in FIG. 6. With reference to FIG. 6, the acceleration method 100 may commence with an 'activate heater, set time count 'S' to zero and start S count' step 102. An "S>Sad" decision 106 may monitor if the time count S is at least the adaptive feed delay period 'Sad' (the adaptive feed delay period Sad equals the difference between S2 and S1 as previously described). If the time count S is at least Sad, then the outcome of decision 106 is positive and the sheet movement may commence during a 'start sheet movement' step 108. The sheet 12 may move along path 20 (FIG. 4) to the imaging component 22 where toner is transferred to the sheet 12 to form a toner image thereon during a 'transfer toner to sheet' step 110. The sheet 12 with toner applied thereto may continue to travel along the path 20 to the fuser 24 (FIG. 4). At the fuser 24, the toner image may be fused to the sheet 12 during a 'fuse toner to sheet' step 112. It should be noted that at essentially the same moment that sheet 12 reaches the fuser 24 (FIG. 4), the fuser 24 reaches the operating temperature T1, thereby allowing for proper fusing during the 'fuser toner to sheet' step 112. After the toner image is fused to the sheet during step 112, the sheet 12 may be ejected from the path 20 during an 'eject sheet with fused image' step 114.

Returning to the 'transfer toner to sheet' step 110, in an alternative embodiment a 'verify that T=T1' step 116 may be provided. This verification step 116 may be utilized for adjusting the adaptive feed delay period Sad in a manner that will be described later herein.

Figure 7:
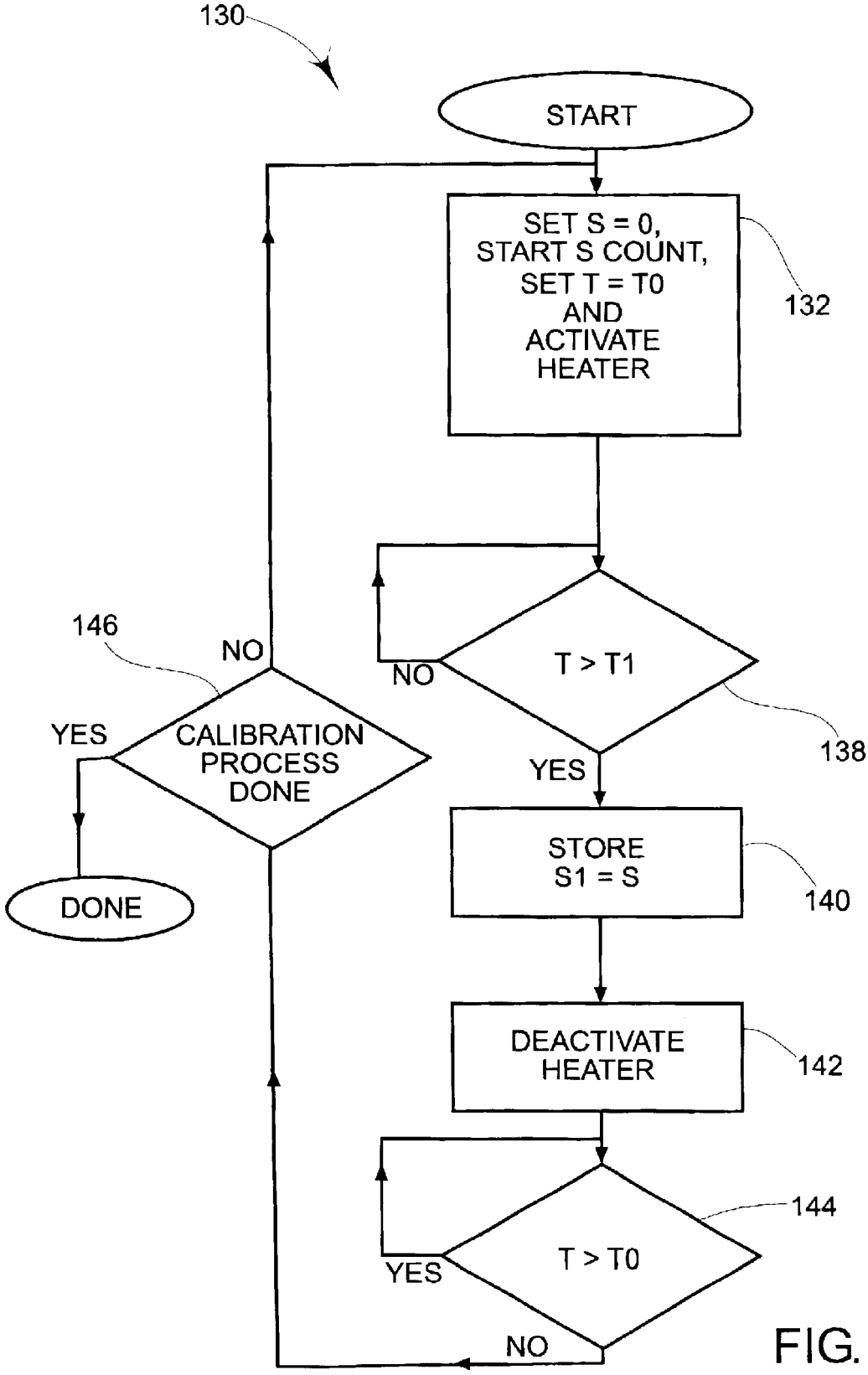
FIG. 7 shows a block diagram of steps occurring during an exemplary calibration process of one embodiment for the exemplary acceleration method of FIG. 6.

The acceleration method may be further provided with a calibration process 130 (FIG. 7). This calibration process 130 may accommodate for factors that are unique to the printer 40 and/or to the environment in which the printer 40 is located. These unique factors may be accounted for when determining the warm-up step period S1 (FIG. 5) and/or the adaptive feed delay period Sad (FIG. 5). Printer factors that may be unique to each printer include, but are not limited to, changes in line voltage, resistance of the heater 32, ambient temperature T0, etc.

With reference to FIG. 7, the calibration process 130 may begin by setting a time count 'S' to zero and starting the time count S during a 'set S=0 and start S count' step 132. During step 132, the ambient temperature may be recorded (as noted in step 132 as 'set T=T0') and the fuser 24 (FIG. 4) may be heated (as noted in step 132 as 'activate heater'). This activation of the heater 32 during step 132 may be substantially similar to the 'activate heater' step 102 during the acceleration method 100 illustrated in FIG. 6. By activating the heater 32 during step 132, the temperature of fuser 24 begins to increase. A 'T>T1' decision 138 may monitor the fuser temperature T to determine if it has reached the operating temperature T1. The temperature T of the fuser 24 may be monitored by the sensor 28 and the controller 60. With a positive outcome to decision 138, the warm-up step period S1 may be recorded during a 'store S=S' step 140. After recording the warm-up step period S1, the heater 32 may be deactivated to bring it back to the ambient temperature T0 during a 'deactivate heater' step 142. A 'T>T0' decision 144 may monitor the fuser temperature T to determine if it has reached the ambient temperature T0. With a negative outcome to decision 144, the entire calibration process 130 starting at step 132 may be repeated. The calibration process may be repeated a number of times in order to obtain a plurality of warm-up step periods S1. This repeating of the calibration process 130 may be monitored by a 'calibration process done' decision 146. In one exemplary embodiment, the calibration process may be repeated five times in order to obtain a plurality of readings (in which case the outcome of decision 146 is positive). This plurality of readings may occur during the first five times that the printer 40 is used, or alternatively may be performed when the printer 40 is activated for the first time by the user. These readings may be mathematically processed in order to find an acceptable warm-up step period S1 and/or adaptive feed delay period Sad. This acceptable warm-up step period S1 may be calculated by any one of a variety of computational methods such as averaging, maximizing, etc. Once the warm-up step period S1 and the adaptive feed delay period Sad are determined, they may be stored in the memory 62 associated with the controller 60 (e.g. by storing a rolling lookup table that continuously adapts the warm-up step period S1 and/or the adaptive feed delay period Sad). The stored periods S1 and Sad may be utilized for ensuring that the sheet 12 is delivered to the fuser 24 as the fuser 24 just reaches the operating temperature T1.

In one alternative embodiment, the acceleration method may be further provided with a verification process. As illustrated in FIG. 6, the fuser temperature T may be confirmed to be equal to the operating temperature T1 during the 'verify that T=T1' step 116. This 'verify that T=T1' step 116 may occur after the 'transfer toner to sheet' step 110 and slightly before or, alternatively, simultaneously with the 'fuse toner to sheet' step 112. This step 116 may allow for feedback that the adaptive feed delay period Sad is still calibrated properly. A variety of factors, such as changes in line voltage, fuser heater resistance, change in ambient temperature T0, etc., may result in the warm-up step period S1 changing (therefore the adaptive feed delay period Sad also changes). In the event that the fuser temperature T is not equal to the operating temperature T1 during step 116, the calibration process 130 can be repeated during an 'adjust Sad' step 118. By repeating the calibration process 130, factors that have changed since the last calibration can be included with the calculation of the warm-up step period S1 (and therefore the adaptive feed delay time Sad).

Furthermore, this verification process may also monitor if the operating temperature T1 occurred before the media reached the fuser 24 (which signals that factors have changed are the printer 40 needs to be recalibrated). If the operating temperature T1 occurred before the media reached the fuser 24, the adaptive feed delay period Sad can be reduced (which results in a reduction of the first page out time).

In another alternative embodiment, the present acceleration method may be implemented with a processing component other than fuser 24. As used herein, the term 'processing component' refers to any component found within an imaging assembly (e.g. printer 40) including, but not limited to, fusing devices, scanning devices, ink drying stations, etc. For illustrative purposes only, a general description of utilization of the present acceleration method with a scanner will now be provided. With reference to FIG. 4, the imaging assembly may be provided with a scanner 50. One type of scanner 50 has an internal motor 52 that takes a period of time S7 to reach an operating speed. This period of time S7 commences at activation of the scanner 50 and terminates upon occurrence of the operating speed. In a manner substantially similar to that described for the fuser 24, the acceleration method may be utilized to monitor (and if desired, calibrate for) the operating speed of the scanner motor 52. The idling state may be defined as the condition when the motor 52 is not running.

Additionally, the processing state may be defined as the condition when the motor 52 is rotating at the operating speed. In other words, when embodied in an imaging apparatus including the scanner 50, the acceleration method can cause delivery of the sheet 12 to the scanner 50 at essentially the same moment that the scanner motor 52 reaches its operating speed.

In an exemplary application to a printer, the present acceleration apparatus and method may provide for a faster first page out time. It should be understood that this exemplary printer application is provided for illustrative purposes only, and this is only one of a variety of applications. In the present exemplary printer, the periods may be about:

| | | |
|---|---|---|
| Warm-up step period, | S1, | 2 Seconds |
| Feed step period, | S2, | 2 Seconds |
| Fusing step period, | S3, | 3.5 Seconds |
| Ejecting step period, | S4, | 0.5 Seconds |

With these exemplary durations, if the conventional sequential printing technique illustrated in FIG. 2 is utilized, the conventional processing period S5 would be about 8 seconds (S1+S2+S3+S4=S5, 2+2+3.5+0.5=8). However, when implemented with the present acceleration method illustrated in FIG. 5, the accelerated processing period S6 would be about 6 seconds (Sad+S2+S3+S4=S5, 0+2+3.5+0.5=6). This accelerated processing period S6 results because Sad is equal to zero (because Sad=S1−S2). This reduction in total print time equates to a first page out time that is reduced by 25 percent (2 second).

While illustrative embodiments have been described in detail herein, it is to be understood that the concepts may be otherwise embodied as previously mention. The appended claims are intended to be construed to include such variations except insofar as limited by the prior art.

I claim:

1. A method comprising:

providing an imaging apparatus comprising an input separated from a processing component by a path, said processing component comprising an idling state and a processing state;

calibrating said imaging apparatus by:

causing said processing component to move from said idling state to said processing state; and determining a warm-up time period by measuring the time required for said processing component to move from said idling state to said processing state;

processing a sheet with said imaging apparatus by:

activating said processing component, thereby urging said processing component from said idling state towards said processing state;

according to said warm-up time period, moving said sheet from said input along said path towards said processing component; and processing said sheet with said processing component.

2. The method of claim 1 wherein said providing said imaging apparatus processing component comprises providing a heater.

3. The method of claim 1 wherein said providing said imaging apparatus processing component comprises providing a toner fuser.

4. The method of claim 1 wherein said providing said imaging apparatus processing component comprises providing a motor.

5. The method of claim 1 wherein said providing said imaging apparatus processing component comprises providing a scanner.

6. The method of claim 1 and further comprising:

verifying that said processing said occurs when said component is in said processing state.

7. The method of claim 1 and further comprising:

providing a controller operatively associated with said imaging apparatus, wherein said controller is operatively associated with memory.

8. The method of claim 1 wherein said calibrating said imaging apparatus further comprises:

causing said processing component to move from said idling state to said processing slate; and determining a second warm-up time period by measuring the time required for said processing component to move from said idling state to said processing state; and calculating an average warm-up time period according to at least said warm-up time period and said second warm-up time period.

9. An imaging apparatus comprising:

an input;

a processing component comprising an Idling state and a processing state;

a path formed between said processing component and said input;

a controller capable of implementing said idling state and said processing state;

an adaptive feed delay period unique to operation of said processing component; end a memory communicatively coupled with said controller, said memory storing said adaptive feed delay period; and wherein said memory storing said adaptive feed delay period comprises a continuous rolling lookup table.

10. The imaging apparatus of claim 9 wherein said processing component comprises a heater.

11. The imaging apparatus of claim 9 wherein said processing component comprises a toner fuser.

12. An imaging apparatus comprising:

an input;

a processing component comprising an idling state and a processing state;

a path formed between said processing component and said input;

a means for determining a warm-up time period of said processing component required to bring said processing component from said idling state to said processing state; and a means for delivering a sheet of media to said processing component along said path at the same moment that said processing component reaches said processing state.

* * * * *

UNITED STATES PATENT AND TRADEMARK OFFICE

CERTIFICATE OF CORRECTION

PATENT NO. : 6,799,004 B2
DATED : September 28, 2004
INVENTOR(S) : Dean J. Richtsmeier It is certified that error appears in the above-identified patent and that said Letters Patent is hereby corrected as shown below:

Column 2,
Line 51, delete “Illustrated” and insert therefor -- illustrated --

Column 3,
Line 53, delete “referent” and insert therefor -- reference --

Column 4,
Line 34, after “point B” insert a period

Column 8,
Line 51, delete “S=S” and insert therefor -- S1=S --

Column 10,
Line 27, delete “mention” and insert therefor -- mentioned --
Line 62, after “processing said” insert -- sheet --

Column 11,
Line 14, delete “Idling” and insert therefor -- idling --
Line 22, after “component;” delete -- end --

Signed and Sealed this

Nineteenth Day of April, 2005

JON W. DUDAS
*Director of the United States Patent and Trademark Office*